US009877572B2

(12) United States Patent
Hopmeier

(10) Patent No.: US 9,877,572 B2
(45) **Date of Patent: *Jan. 30, 2018**

(54) HIGH VOLUME INDIVIDUAL FLUID TRANSPORT DEVICE

(71) Applicant: Watervest, LLC, Mary Esther, FL (US)

(72) Inventor: Michael J. Hopmeier, Mary Esther, FL (US)

(73) Assignee: Watervest, LLC, Mary Esther, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/453,207

(22) Filed: Mar. 8, 2017

(65) Prior Publication Data

US 2017/0367465 A1 Dec. 28, 2017

Related U.S. Application Data

(63) Continuation of application No. 14/662,516, filed on Mar. 19, 2015, now Pat. No. 9,591,911.
(Continued)

(51) Int. Cl.
*A45F 3/00* (2006.01)
*A45F 3/16* (2006.01)
*A41D 3/08* (2006.01)

(52) U.S. Cl.
CPC ..... *A45F 3/16* (2013.01); *A41D 3/08* (2013.01); *A41D 2400/46* (2013.01); *A45F 2003/166* (2013.01)

(58) Field of Classification Search
CPC ..... A45F 2003/166; A41D 2400/46
(Continued)

(56) References Cited

U.S. PATENT DOCUMENTS 262,577 A * 8/1882 Day ..... A41D 13/0012 2/247
735,876 A * 8/1903 Holland ..... B65D 33/02 383/103

(Continued)

FOREIGN PATENT DOCUMENTS

WO WO 2010/132377 11/2010

OTHER PUBLICATIONS

PCT Search report for PCT/US2015/21430, dated Jul. 2, 2015.

*Primary Examiner* — Justin Larson
(74) *Attorney, Agent, or Firm* — Remenick PLLC

(57) ABSTRACT

The invention comprises devices and methods for carrying quantities of materials preferably fluids. The device of the invention is preferably a wearable garment such as, preferably a vest or poncho, with one or more bladders or compartments adapted to hold a fluid. Preferably the garment comprises fluid connections between the bladders. The connections allow for the distributing the load over the carrier, which is preferably a person. The invention is designed to be inexpensive to manufacture, capable of easy manufacture in large numbers, and, if desired, disposable or repurposed. The device significantly enhances the ability of an individual to provide water or other fluids or materials to individuals or groups such as families. Preferably the invention allows for the transport of potable water from a supply point to the point of end use with minimal or no discomfort to the wearer. Preferably the invention supports the heating and/or cooling of the fluid or other applications, including use of building materials.

20 Claims, 2 Drawing Sheets

Related U.S. Application Data

(60) Provisional application No. 61/955,878, filed on Mar. 20, 2014, provisional application No. 62/021,375, filed on Jul. 7, 2014.

(58) Field of Classification Search
USPC ..... 224/148.1, 148.2, 148.6
See application file for complete search history.

(56) References Cited

U.S. PATENT DOCUMENTS 1,003,856 A * 9/1911 Adams ..... B05B 7/2408 224/148.2
1,637,635 A * 8/1927 Corley ..... B65D 7/02 222/175
1,650,764 A * 11/1927 Marin ..... A41F 9/002 224/148.1
2,024,908 A * 12/1935 Blum ..... B29D 22/006 383/105
2,852,168 A * 9/1958 Suellentrop ..... B65D 83/46 222/402.22
4,061,161 A 12/1977 Greer
4,090,650 A * 5/1978 Gotta ..... A45F 3/20 215/11.1
4,139,130 A * 2/1979 Glusker ..... A45F 3/16 2/312
4,265,381 A * 5/1981 Muscatell ..... A41F 9/002 2/312
4,357,009 A * 11/1982 Baker ..... A63B 21/065 482/105
4,370,754 A 2/1983 Donzis
4,544,087 A * 10/1985 Modig ..... A45F 3/16 224/148.2
4,580,408 A * 4/1986 Stuebner ..... A41D 13/0056 2/2.5
4,703,927 A * 11/1987 Hanzlik ..... A45F 3/16 215/6
4,932,566 A * 6/1990 Weinbaum ..... A47K 5/122 222/175
4,948,023 A * 8/1990 Tripp ..... A45F 3/16 222/175
4,951,940 A * 8/1990 Vitello ..... A63B 21/0602 224/148.1
4,998,415 A * 3/1991 Larsen ..... A41D 13/0053 62/231
5,203,325 A * 4/1993 Carr ..... B63C 11/184 128/202.23
5,207,362 A * 5/1993 Janus ..... A45F 3/16 215/389
5,282,557 A * 2/1994 McCook ..... A45F 3/16 222/175
5,303,425 A * 4/1994 Mele ..... A41D 13/0053 2/102
5,358,142 A * 10/1994 Holmes ..... B62J 11/00 222/1
5,431,308 A * 7/1995 Tchen ..... A45F 3/16 222/175
5,622,293 A * 4/1997 LeFevre ..... A44C 5/003 220/212
5,864,880 A * 2/1999 Adam ..... A41D 1/04 2/108
6,126,041 A * 10/2000 DiTomasso ..... A45F 3/20 222/175
6,149,557 A * 11/2000 Williams ..... A63B 21/06 482/105
6,220,490 B1 * 4/2001 O'Hara ..... A45F 3/16 2/102
6,371,444 B1 * 4/2002 Hahn ..... B29C 45/16 251/309
6,581,811 B1 * 6/2003 Schillaci ..... A45F 3/16 220/666
6,598,770 B2 * 7/2003 Bolts ..... A45F 3/00 224/148.2
6,942,015 B1 * 9/2005 Jenkins ..... A41D 13/005 165/104.14
7,373,969 B2 5/2008 Chambers
7,552,734 B2 * 6/2009 Adams ..... A01K 7/00 128/847
7,641,082 B2 * 1/2010 Seton ..... A01C 15/003 222/175
7,665,156 B1 * 2/2010 Hewitt ..... A41D 13/0518 2/455
8,082,753 B1 * 12/2011 Alvarez, Jr. ..... A45F 3/16 224/148.1
8,083,105 B2 * 12/2011 Reichert ..... A45F 3/20 220/703
8,226,831 B2 * 7/2012 Maiden ..... A45F 3/20 210/241
8,444,021 B1 * 5/2013 Ferreiro ..... A45F 3/20 222/175
8,540,122 B2 * 9/2013 Skillern ..... A45C 11/20 220/703
8,672,544 B2 * 3/2014 Andochick ..... B65D 37/00 383/209
8,839,996 B2 * 9/2014 Parazynski ..... A45F 3/16 224/148.2
9,101,793 B1 * 8/2015 Kervin ..... A63B 21/065
D740,020 S * 10/2015 Kohen ..... D2/828
9,591,911 B2 * 3/2017 Hopmeier ..... A45F 3/16
D794,913 S * 8/2017 Hopmeier ..... D2/829
2005/0218154 A1 * 10/2005 Selsby ..... A61F 5/44 222/94
2007/0012732 A1 * 1/2007 Adams ..... A01K 7/00 224/148.2
2007/0056998 A1 * 3/2007 Olson ..... A45F 3/20 224/148.2
2007/0090135 A1 * 4/2007 Benham ..... A45F 3/20 224/148.2
2010/0101253 A1 * 4/2010 Searle ..... A41D 13/0025 62/259.3
2010/0102002 A1 * 4/2010 O'Brien ..... C02F 1/002 210/668
2010/0308086 A1 * 12/2010 Chapuis ..... A45F 3/04 224/148.2
2012/0227432 A1 9/2012 Creech et al.
2015/0265033 A1 * 9/2015 Hopmeier ..... A45F 3/16 224/148.1

* cited by examiner

HIGH VOLUME INDIVIDUAL FLUID TRANSPORT DEVICE

REFERENCE TO RELATED APPLICATIONS

This application is a continuation of U.S. Non-Provisional application Ser. No. 14/662,516, filed Mar. 19, 2015, which claims priority to U.S. Provisional Application Nos. 61/955,878, filed Mar. 20, 2014, and 62/021,375, filed Jul. 7, 2014, all entitled "High Volume Individual Fluid Transport Device," and are hereby specifically and entirely incorporated by reference.

BACKGROUND

1. Field of the Invention

This invention is directed to materials and methods for containing, maintaining and transporting fluids. In particular, the invention is directed to materials that can be adapted to a body and distribute weight of a fluid material for personal transportation and storage.

2. Description of the Background

In spite of many technological developments in transportation, people around the world are still reduced to carrying materials manually or by hand. This is especially true in third world countries, in areas where other mechanical devices are unavailable and in areas that have been hit by natural or man-made disasters. In such areas, a person will carry the maximum weight that his or her muscles will allow. The typically maximum carrying capacity of a person ranges from about 20 to about 50 pounds, somewhat more for the very strong and somewhat less for children and small individuals.

The ability to manually carry a heavy load is commonplace in many parts of the developing world and often a daily routine. When the weight is too great for the hands or arms, people have learned to carry excessively large weights on their heads, backs or shoulders. Although crude, shifting the weight from the muscles of the arms to the muscles of the entire body allows an individual to transport more weight and over longer distances. Shifting a heavy object to the head especially allows for greater weight carrying capacity. For example, in India, people transport baskets of bricks to works on construction sites by balancing the bricks on their backs. In East Africa, people transport loads of up to 70% of their own body weight balanced on top of their heads. Such loads are often simply water or firewood. With practice, individuals can balance such loads with no other means of securing the material to the body. However, people of the Kikuyu tribe often incorporate a leather strap wrapped around their forehead to maintain the load on a person's head. Aside from the obvious headaches, the strap often creates a permanent groove in the forehead.

Interestingly, 20% or more of the person's body weight can be carried on the head with little extra exertion of energy. This energy savings can be critical in areas of the world that have limited resources, including disaster areas.

In many underdeveloped areas of the world, affluent residents employ young people and even children, as head porters to transport water. After the tsunami in Achi, Indonesia, movement of water from supply points to families was severely limited and often done by carrying quantities of small (one liter) bottles or by balancing large open buckets on the head. In the Philippine Islands, after Typhoon Haiyan, rebuilding was hampered due to limited ability to transport water to outlying areas.

The "last mile" problem of water distribution in quantities beyond individual use (more then what a single person can use in a practical period of time), but short of wholesale volumes (quantities beyond what an individual can transport easily) presents a significant challenge in a variety of circumstances, including response to large scale disasters. While there is frequently potable water available in a situation of this nature (disaster relief water purification plants, or tanks of fresh water being provided in bulk quantities, such as in large storage bladders or by tanker truck), transport of this water to the point of use (e.g., a home, kitchen, shelter) in volumes beyond what a single individual would use is extremely difficult. Transportation was limited to foot transport as roads were impassable.

Current tools and methods are simply inefficient and waste immense amounts of materials and resources. Presently there is an urgent need for the inexpensive yet efficient transport of materials by a single individual across a distance.

SUMMARY OF THE INVENTION

The present invention overcomes the problems and disadvantages associated with current strategies and designs and provides new tools and methods for hygienic and practical transportation of fluids such as potable water or other fluids, in volumes greater than traditional methods, cost effectively and usable by one or more people (such as a family), in situations where potable water needs to be transported and/or stored, such as during a disaster or when mid (between roughly 10 liters and 200 liters) volume transport systems do not exist.

One embodiment of the invention is directed to a wearable device for transporting fluids, comprising a plurality of bladders, each bladder having at least a five liter capacity; two shoulder straps coupling the two bladders; and an opening positioned between the two bladders and two shoulder straps, wherein the device is adapted to be worn by a person. Preferably, the plurality of bladders is watertight and/or airtight. Also preferably, at least one bladder of the plurality of bladders contains at least one baffle that stabilizes the contents and prevents sudden shifts of weight. The device may have at least one filling device, preferably a reed valve, which may comprise a filter to prevent contaminants such as virus, parasites and/or bacteria from entering the bladder. Preferably the wearable device comprises one or more connectors to secure the device to the person, or is designed to fit an individual without any connectors. Preferably each bladder has a capacity of at least 5 liters, more preferably at least 10 liters and more preferably at least 20 liters. Also preferable is a device that has a bladder volume capacity of between five and ten liters. Also preferably, the device may be biodegradable or comprised of a material that can be re-purposed as, for example, construction materials that can be re-used as a shelter, such as, for example, for protection from sun, rain, snow, heat, cold or other forms of protection (e.g. camouflage) or containment.

Preferably the wearable device comprises a heating or cooling device that provides heat or cooling to the contents of the bladders or to the person. Also preferably, the bladders may be coated with or otherwise contain one or more enzymes or chemicals to treat the fluid contents. The chemicals may be disinfectants, drugs, or nutritional supplements. Preferably, however, the chemicals serve as disinfectants, such as, for example, chlorine or iodine, or a pharmaceutical, such as, for example, an antibiotic. Containers may also comprise a weight or fluid equalization device, or one or more grommets that provide access to the container interior wherein the grommets are flared or collared both on an inside surface and an outside surface of the container Another embodiment of the invention is directed to a wearable garment for transporting materials, comprising a flexible, tubular container sealed at both ends to contain a fluid and a valve coupled to the container, wherein the container has at least a five liter volume capacity and is adapted to be worn by a person. The length of the garment is preferably more than 10 times a diameter of the container. The container mater is preferably plastic with a preferred thickness of between 2 and 4 mils.

The device is preferably adapted to be supported by a human body, preferably a human neck, shoulder, or waist. The device is preferably adapted to be wrapped around a human body one or more times, or may be adapted to be worn by an animal or supported by a vehicle. The garment may be supported by straps and other structural components.

The garment may be coupled to one or more identical garment or containers to form a multi-chambered garment. Portions of the garment and/or containers may be couple-able to other portions of the other garment and/or container to form varied configurations. Portions of the garment may also be couple-able to one or more external components to form varied configurations.

Other embodiments and advantages of the invention are set forth in part in the description, which follows, and in part, may be obvious from this description, or may be learned from the practice of the invention.

DESCRIPTION OF THE FIGURES

The invention is described in greater detail by way of example only and with reference to the attached drawing, in which.

DESCRIPTION OF THE INVENTION

Figure 1:
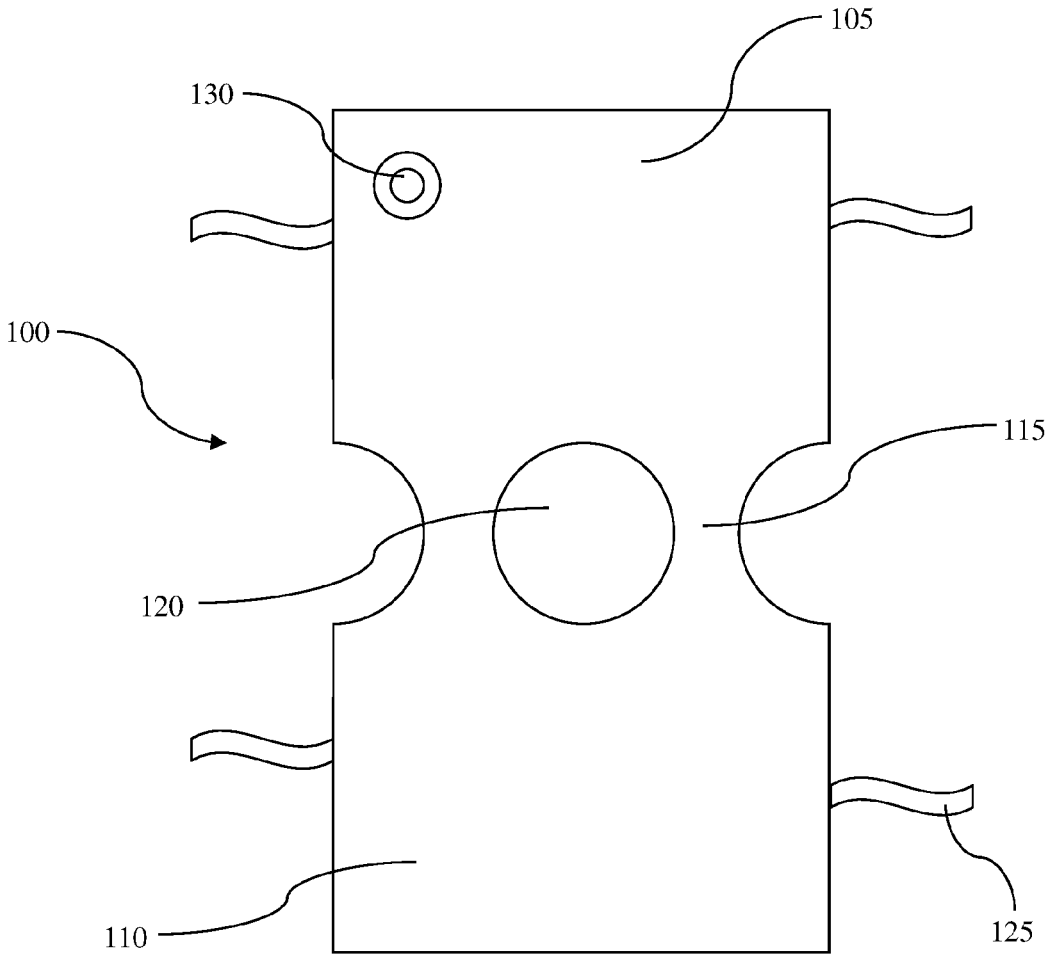
FIG. 1 depicts an embodiment of the wearable container device.

As embodied and broadly described herein, the disclosures herein provide detailed embodiments of the invention. However, the disclosed embodiments are merely exemplary of the invention that may be embodied in various and alternative forms. Therefore, there is no intent that specific structural and functional details should be limiting, but rather the intention is that they provide a basis for the claims and as a representative basis for teaching one skilled in the art to variously employ the present invention There are numerous obstacles that need to be overcome in supplying food, potable water and other supplies to people in need. Such needs occur after, for example, natural disasters, war and/or other conflicts and are addressed, as best as then currently possible, through relief organizations. Relief organizations address the obstacles associated with obtaining the supplies and getting the supplies to a central location for the target population. There are few, if any, organization that address the problems associated with providing that "last mile" of distribution to individuals, families and small groups. One of the most critical of the "last mile" problems is the distribution of clean water.

It has been surprisingly discovered that clean water and other fluids can be provided to individuals simply and inexpensively with the devices of the invention disclosed and descried herein. Such devices are generally referred to as water vests or water ponchos that are wearable materials. This invention disclosed herein provides devices and methods for transporting and storing fluids such as clean and/or potable water in individual or personal quantities, preferably about forty liters or the carrying capacity of an individual, a vehicle or a service animal. Preferably the device is a garment capable of being worn by one or more individuals with no external support needed and operates effectively in a resource constrained environment.

In one embodiment, the invention comprises wearable materials that contain one or more hollow cores or containers with a series of reinforcements and optionally barriers and/or baffles between or creating compartments. The cores which are designed to contain the fluid may be any shape or structure such as, for example, squares, rectangles, triangles, circles, ovals, tubes, vest shapes, sleeve shapes, shoulder shapes, or shaped as any body portion. The compartments may be within distinct regions of the garment or as overlapping layers of containers of the same shape. The device may contain one of multiple compartments for holding fluid with one or more valves, which may be of any desired size, that can be open or closed, or adjustable by the wearer or fixed in size by the manufacturer. When the valves are open, fluid can be added or removed from the containers. The wearable material or garment may also contain baffles in one, multiple or all compartments to prevent contents such as, for example, fluids from moving rapidly between compartments or reduce fluid flow between compartments, or to constrain the deformation of the garment while loaded. The valves may be open or restricted to allow fluid to move only slowly between compartments thereby preventing sudden shifts of weight. Valves may also operate one-way to prevent leakage of the compartments after filling. Alternatively or in addition, compartments may contain baffles to reduce the intensity of fluid movement. When closed, the compartments create separate bladders (e.g., bladders as layers or as non-overlapping portions of the garment) that can be filled with most any matter capable of flowing through a valve, such as, for examples, fluids, including liquids, powders and potentially solids. Preferably, the bladders are filled with, for example, water, edible or cooking oil, gasoline, kerosene, a powder, or sterilizing fluid. In addition, the device may contain solid materials that can easily flow such as a powder, sand, or grains such as, for example, rice, beans or wheat, or another thixotropic substance. Included in the invention are connections that allow for ease of both filling and emptying of the various bladders or compartments, either individually or in aggregate.

In embodiments with multiple compartments, the different compartments may be in fluid communication with each other or may be completely separate. When separate, the compartments may contain the same or different materials. Additionally, the compartments need not be the same size and can be different sizes. Different compartments may be adapted to be filled with different materials. In some embodiments, at least one compartment may be prefilled with a substance to be maintained as separate from the contents of another compartment or the contents are to be mixed with other compartments and mixing can be initiated by the user while in use (for example when being worn by a user which requires valves and switches) or when the contents are removed. For example, one compartment may be fillable with water and a second, smaller compartment may be prefilled with, for example, iodine or another desirable substance at an effective amount that would provide a desired substance concentration with blended or mixed with the contents of the first container. Preferable, the user mixes the substance with the fluid as desired. The substance compartment may be a single use compartment or may be adapted for multiple uses. Alternatively, there may be multiple substance compartments for multiple uses. The smaller compartment may be a blister package, have a dissolvable wall, easily rupture under pressure, have a puncture device, or otherwise be openable. The smaller compartment may be positioned within or without the larger compartment. In another embodiment, the smaller compartment may be loose within the larger compartment.

Also preferably, valve design can be used to seal and protect contents from exposure to the outside environment. Maximum capacity loads per garment can be individually designed and are preferably at least 10 kg, preferably 20 kg or more, more preferably 30 kg or more, more preferably 40 kg or more, more preferably 50 kg or more, more preferably 60 kg or more, more preferably 70 kg or more, more preferably 80 kg or more, more preferably 90 kg or more and even more preferably 100 kg or more. When the load is a fluid such as, for example water, a 40 kg capacity garment would carry a volume of 40 liters. The invention preferably takes the form of a wearable garment, such as for example, a vest or poncho, designed to fit over the head or other configuration across the body such that the load is distributed. Preferably the load is also controllable in such a way as to allow for optimal movement of the carrier. Size and capacity are designed to address a variety of needs, such as for multiple individuals or animals or tasks. While the invention is described herein as a vest or poncho, it may take the form of another garment. For example, a jacket or shirt (with or without sleeves), a backpack, a saddle, or pants, any of which can be included in place of, over or under other or similar garments.

The garments of the invention may be composed of one or a variety of materials, such as, for example, one or more of plastics, rubbers, natural or synthetic fibers, memory plastics, and/or bioplastics. Preferably, the garment is of a unibody design comprising a single material that is easily and inexpensively manufactured. Preferably, the material is a plastic that is synthetic or semi-synthetic organic solid that is easily moldable. Plastics of the invention include organic polymers of high molecular mass and may contain other substances that provide desired physical characteristics to the plastic (e.g., tensile strength, tear resistance, stretching or anti-stretching agents, plasticizers, colorants, anti-bacterial coatings). Plastics of the invention are preferably derived from petrochemicals or combinations of petrochemicals such as, for example, acrylics, polyethylene (e.g., polyethylene terephthalate high-density and low-density polyethylenes), polyesters, silicones, polyurethanes, polycarbonates, acrylonitrile butadiene styrene, and/or halogenated plastics (e.g., polystyrene, high-density polystyrene, polyvinyl chloride), nylon (e.g., polyamides), rubber, and synthetic rubber. Preferably the material is a biodegradable and heat resistant, thermoplastic composed of modified corn starch which is entirely biodegradable. Preferably the material(s) of the garment contain no undesirable substances such as bisphenols, alkylphenols, formaldehydes, phthalates (e.g., DEHP {di-2-ethylhexyl phthalate}, DPB, BBP, DINP, DIDP and DnOP). Also preferably, the garments of the invention are biodegradable, recyclable and/or can be repurposed.

Preferably, the walls of the garment of the inventions are of a thickness appropriate to contain the weight of the intended fluid capacity. More preferably, the garments are designed to support 120% of the intended maximum capacity, more preferably 150%, more preferably 200%, more preferably 300%, more preferably 400%, and even more preferably 500%. The reason for the increased strengths of the materials and design is to allow for repeated use. For garments of the invention designed for single use and disposal, materials are preferably design for a weight carrying capacity of about 110% of the maximum load.

For garment of the invention that are composed of plastics, the design is preferably of a unibody manufacture and construction composed of sheets of polyethylene or polypropylene of between about 0.5 mils and about 5 mils thickness, preferably between about 1 and about 4 mils, and more preferably between about 2 and about 3 mils.

Preferably the garment of the invention is wearable and allows the wearer to perform tasks that the individual would otherwise perform without the garment. Such tasks preferably include siting, walking, running, entering a vehicle and the like. Preferably the garment is inexpensive and can be manufactured and transported easily, inexpensively and in large numbers. Also preferably, the compartments or bladders can be fillable on site with minimal or no special adaptions and the garment provides for easy adjustment and configuration to the wearer.

Preferably the containers contain one or more chemicals such as, for example, chemicals to sterilize the fluid (e.g., a salt, iodine, chlorine) or pharmaceuticals (e.g., antibiotics) to be administered to an individual, a group or a population in association with the contents of the container. Preferred wearable containers can be re-purposed as, for example, but not limited to clothing, construction materials, animal feed, fertilizer, sun shields, tents or shelters from the environment. Preferably the re-purposing of the containers is directed to the use of such containers as a vest, a scarf, or an environmental protectant, a floatation device, or an edible item.

Another embodiment of the invention is directed to methods for rapidly and easily filling and/or emptying of the various bladders. Preferably there is a single fill point for all bladders of the container. Although the fill point may also be the emptying point (in other words only a single access to the container), separate drains may be included with the container or with each bladder. Preferably, there is at least one overflow device to prevent overfilling of the bladders.

Another embodiment of the invention is directed to a wearable device for transporting materials, comprising a flexible, tubular container or multiple tubes sealed at both ends of the tubes; wherein the container has at least a five liter capacity and is adapted to be worn by a person. The container may be any length, but is preferably between ten and seventy inches, but can be greater as needed or as adapted to the person or persons. The length of the container may be in any proportion to the diameter of the container, but preferably the length of the container is more than ten times a diameter of the container. The container can be made of any suitable waterproof material, but is preferably made of a plastic material. The material may be any thickness, but is preferably between 0.5 and 10 mils, or between 1 and 8 mils, and more preferably between 2 and 4 mils. Preferably the material is opaque but may be of any color or no color, or clear. Certain colors or designs may be applied to the material during manufacture or after manufacture, such as decals, with designs, words or colors. Such designs words and/or colors may attribute origin, directions of use, one or more re-usable applications, or any other message to the user or others who have visual access to the device.

The device can be worn around any portion of the human body, but is preferably secured around the neck, shoulders, or waist of a human body. The device can be wrapped around the body one or more times, or secured to the body using straps or other external components. The device may also be wrapped around an animal body one or more times, or secured to the animal body using straps or other external components, or placed on the back or shoulders of an animal such as a horse, mule, donkey, ox, camel, dog, or other beast of burden. The device may also be secured to a vehicle or platform using straps or other external components, or placed on the flat surface of a vehicle or platform.

Preferably, the device can be coupled to one or more identical or non-identical containers to form a multi-chambered container. The device can also be coupled to other portions of other devices or containers, or to one or more external components to form varied configurations of shape and size.

The following examples illustrate embodiments of the invention, but should not be viewed as limiting the scope of the invention.

EXAMPLES

FIG. 1 depicts a top view of an embodiment of the invention. In the preferred embodiment, the container 100 is a wearable device. Preferably container 100 is a garment capable of being worn on a human's shoulders as a vest. In other embodiments, container 100 may be a jacket, a backpack, a head worn device, a belt, or another shape capable of being carried by a human. In the preferred embodiment container 100 is comprised of one sheet of material or two superimposed sheets of material coupled together at the edges. Preferably, the container is watertight. For example, the sheets of material can be plastic, nylon, wax impregnated cloth, PLA, polyester, rubber, or another waterproof and flexible material. The seams of container 100 may be welded, sown, crimped, fused, glued, or otherwise coupled in a watertight manner. Preferably, container 100 is airtight.

Preferably, container 100 is comprised of two main bladders 105 and 110 coupled together at shoulder straps 115. Bladders 105 and 110 may be capable of being filled with liquids or solids completely or may be baffled. Bladders 105 and 110 may be capable of containing water, food, building materials, insulation, combustible materials, drugs, ice, or other bulk materials. Preferably, when worn, one of bladder 105 and 110 is positioned in front of the wearer and the other of bladder 105 and 110 is positioned behind the wearer. Preferably, bladders 105 and 110 are of equal size to balance the weight of the material held therein. Shoulder straps 115 may also be capable of being filled with material and, thereby, provide a conduit for the material to flow between bladder 105 and 110. In other embodiments, container 100 may have other equalization devices to balance the material held within bladders 105 and 110. Additionally, shoulder straps 115 may be sealed and prevent material to flow between bladder 105 and 110. Preferably, when worn, shoulder straps 115 are placed on the wearer's shoulders. Additionally, between shoulder straps 115 and bladders 105 and 110 may be a head hole 120 so that container 100 can be placed over the wearer's head. While container 100 is described herein with reference to being worn by a human, container 100 may be designed to be worn by another animal (e.g. donkey, camel, horse, or dog). Furthermore, container 100 may be able to be transported on a motorized or human powered vehicle (e.g. a car, motorcycle, bicycle, truck, or airplane).

Attached to the sides of each bladder 105 and 110 may be restraining devices 125 to secure container 100 to the wearer's body. For example the restraining devices 125 can be ties, clips, Velcro, belts, or other fastening devices. In a preferred embodiment, container 100 may also comprise a filling device 130. For example filling device may be a reed valve, another valve, a sealable hole, a spigot, or another device through which material can flow. Preferably filling device 130 allows for ingress and egress of filling material. However, in certain embodiments there may be an input device and a separate output device. While FIG. 1 shows one filling device 130 two or more filling devices can be implemented. Preferably filling device 130 may allow for controlled or uncontrolled filling and un-filling. Container 100 may additionally have holes or grommets that allow container 100 to be attached to other items or allow other items to be attached to container 100.

Preferably, container 100 is capable of storing group sized quantities (20-100 liters) of material. The quantities of material stored are preferably such that the wearer can transport container 100 short distances (e.g. within walking or draft animal transport distance) without need for mechanical support. Container 100 may have a heating device coupled thereto. For example, there may be solar or other passive or active heating or cooling devices to allow the contents of container 100 to be used for a variety of purposes, including drinking, cooking, or bathing.

Container 100 may be made of biodegradable materials thereby alleviating the need for recycling or environmentally friendly disposal. In another embodiment container 100 may be made of infrastructure building material to support recovery in a disaster environment, such as building material, shelter, windows or other construction applications.

Container 100 preferably allows for the introduction of one or more chemicals (e.g., salt or chlorine at non-toxic levels), either during manufacture or at a subsequent point to purify water or otherwise change its chemical nature, to provide nutrients (e.g., vitamins, amino acids), to provide medications (e.g., pharmaceuticals, antibiotics), or a combination thereof. For example, the interior of container 100 may be coated with iodine, chlorine, or another disinfectant.

Figure 2:
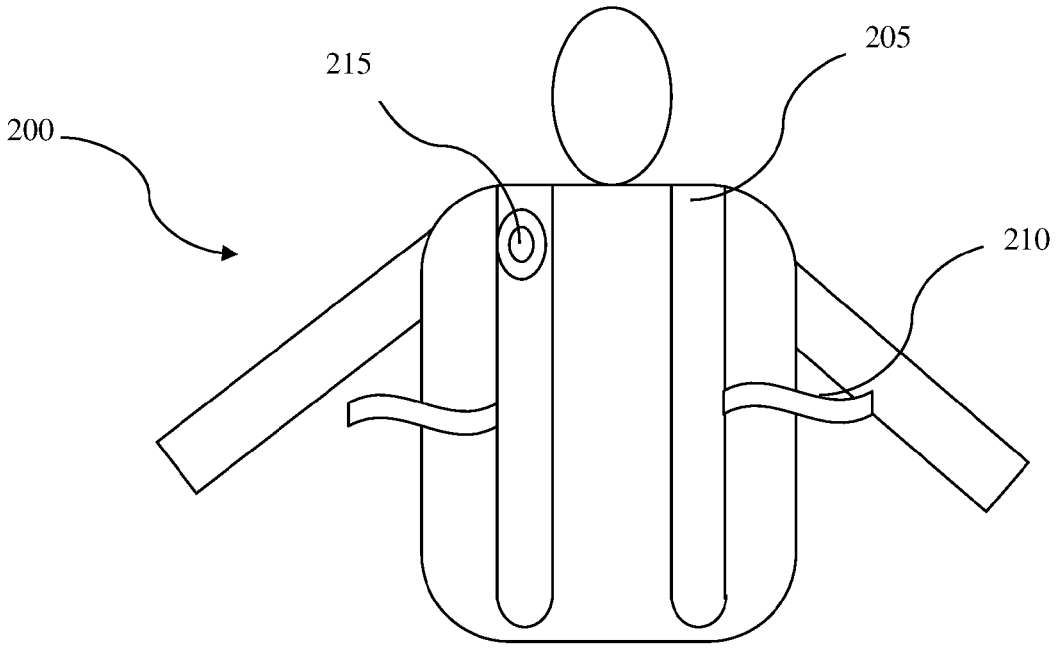
FIG. 2 depicts another embodiment of the wearable container device.

FIG. 2 is a sketch of a garment of a personal fluid transportation devise of the invention that is designed to be wrapped about the neck. In the preferred embodiment, the container 200 is a wearable device. Preferably container 200 is a garment capable of being worn on a human's shoulders as a scarf. In other embodiments, container 200 may be a jacket, a backpack, a head worn device, a belt, or another shape capable of being carried by a human. In the preferred embodiment container 200 is comprised of one superimposed sheet of material coupled together at the edges. In another embodiment, container 200 is comprised of a single sheet of material with ends coupled together in a tube configuration. Preferably, the container is watertight. For example, the sheets of material can be plastic, nylon, wax impregnated cloth, PLA polyester, rubber, or another waterproof and flexible material. The seams of container 200 may be welded, sown, crimped, fused, or otherwise coupled in a watertight manner. Preferably, container 100 is air tight.

Preferably, container 200 is comprised of a bladder. Bladder 205 may be capable of being filled with liquids or solids completely or may be baffled. Bladder 205 may be capable of containing water, food, building materials, insulation, combustible materials, drugs, ice, or other bulk materials. Preferably, when worn, bladder 205 is positioned either in front of the wearer or behind the wearer. In other embodiments, container 200 may have other equalization devices to balance the material held within bladder 205. Preferably, when worn, bladder 205 is wrapped around the wearer's neck. While container 200 is described herein with reference to being worn by a human, container 200 may be designed to be worn by another animal (e.g. donkey, camel, horse, or dog). Furthermore, container 200 may be able to be transported on a motorized or human powered vehicle (e.g. a car, motorcycle, bicycle, auto, truck, or airplane).

Attached to the sides of bladder 205 may be restraining devices 210 to secure container 200 to the wearer's body. For example the restraining devices 210 can be ties, clips, Velcro, belts, or other fastening devices. In a preferred embodiment, container 200 may also comprise a filling device 215. For example filling device may be a reed valve, another valve, a sealable hole, a spigot, or another device through which material can flow. Preferably filling device 215 allows for ingress and egress of filling material. However, in certain embodiments there may be an input device and a separate output device. While FIG. 2 shows one filling device 215, two or more filling devices can be implemented. Preferably filling device 215 may allow for controlled or uncontrolled filling and un-filling. Container 200 may additionally have holes or grommets that allow container 200 to be attached to other items or allow other items to be attached to container 200.

Preferably, container 200 is capable of storing group sized quantities (20-100 liters) of material. The quantities of material stored are preferably such that the wearer can transport container 200 short distances (e.g. within walking or draft animal transport distance) without need for mechanical support. Container 200 may have a heating device coupled thereto. For example, there may be solar or other passive or active heating or cooling devices to allow the contents of container 200 to be used for a variety of purposes, including drinking, cooking, or bathing.

Container 200 may be made of biodegradable materials thereby alleviating the need for recycling or environmentally friendly disposal. In another embodiment container 200 may be made of infrastructure building material to support recovery in a disaster environment, such as building material, shelter from wind, cold, heat, rain or sun, windows or other construction applications.

Container 200 preferably allows for the introduction of one or more chemicals (e.g., salt or chlorine at non-toxic levels), either during manufacture or at a subsequent point to purify water or otherwise change its chemical nature, to provide nutrients (e.g., vitamins, amino acids), to provide medications (e.g., pharmaceuticals, antibiotics), or a combination thereof. For example, the interior of container 200 may be coated with or impregnated with, such as during manufacture, for example, iodine, chlorine, or another disinfectant.

The disclosures herein provide detailed embodiments of the invention. Other embodiments and uses of the invention will be apparent to those skilled in the art from consideration of the specification and practice of the invention disclosed herein. All references cited herein, including all publications, U.S. and foreign patents and patent applications, are specifically and entirely incorporated by reference. The term comprising, where ever used, is intended to include the terms consisting and consisting essentially of. Furthermore, the terms comprising, including, and containing are not intended to be limiting. It is intended that the specification and examples be considered exemplary only with the true scope and spirit of the invention indicated by the following claims.

The invention claimed is:

1. A wearable device for transporting materials comprising:

two superimposed sheets of material, each sheet of material having two parallel long edges and two parallel short edges, the two superimposed sheets of material sealed along the four edges to create at least two bladders for holding fluid;

at least one filling port coupled to the at least two bladders;

straps formed from the two superimposed sheets of material and positioned between the at least two bladders; and an opening through both superimposed sheets of material positioned between the straps, the opening having an opening edge, wherein the two superimposed sheets of material are sealed at the opening edge.

2. The device of claim 1, wherein the at least two bladders are watertight and/or airtight.

3. The device of claim 1, wherein each bladder contains a baffle and/or a volume equalization device.

4. The device of claim 1, wherein the filling port comprises a valve.

5. The device of claim 1, wherein each bladder has no more than about a twenty-liter volume capacity.

6. The device of claim 1, which is composed of biodegradable, recyclable, and/or a re-usable construction material.

7. The device of claim 1, wherein the interior of the at least two bladders is coated with or contains at least one of a disinfectant, a drug, or a nutrient.

8. The device of claim 1, wherein the material is at least one of water, food, building materials, insulation, combustible materials, or drugs.

9. The device of claim 1, wherein each bladder further comprises one or more reinforcements.

10. The device of claim 1, wherein the two parallel long edges have recessed portions at the straps.

11. A wearable device for transporting materials comprising:

a single sheet of material formed into a tube and flattened into a substantially rectangular shape having a first surface and a second surface and creating two parallel long edges and two parallel short edges, where the edges of the sheet of material are sealed to create at least two bladders for holding a material;

at least one filling port coupled to the at least two bladders;

straps formed from the sheet of material and positioned between the at least two bladders; and an opening through both the first surface and the second surface of the sheet of material and positioned between the straps, the opening having an opening edge, wherein the sheet of material is sealed at the opening edge.

12. The device of claim 11, wherein the at least two bladders are watertight and/or airtight.

13. The device of claim 11, wherein at least one bladder contains a baffle and/or a volume equalization device.

14. The device of claim 11, wherein the filling port comprises a valve.

15. The device of claim 11, wherein each bladder has no more than about a twenty-liter volume capacity.

16. The device of claim 11, which is composed of biodegradable, recyclable, and/or a re-usable construction material.

17. The device of claim 11, wherein the interior of the at least two bladders is coated with or contains at least one of a disinfectant, a drug, or a nutrient.

18. The device of claim 11, wherein the material is at least one of water, food, building materials, insulation, combustible materials, or drugs.

19. The device of claim 11, wherein each bladder further comprises one or more reinforcements.

20. The device of claim 11, wherein the two parallel long edges have recessed portions at the straps.

* * * * *